US006626732B1

(12) United States Patent
Chung

(10) Patent No.: US 6,626,732 B1
(45) Date of Patent: Sep. 30, 2003

(54) CHARACTER TOY

(75) Inventor: Dong Hyun Chung, Seoul (KR)

(73) Assignee: The Flying Co., Ltd., Gyeonggi-Do (KR)

( * ) Notice: Subject to any disclaimer, the term of this patent is extended or adjusted under 35 U.S.C. 154(b) by 0 days.

(21) Appl. No.: 10/274,368

(22) Filed: Oct. 21, 2002

(51) Int. Cl.[7] ..... A63H 3/08

(52) U.S. Cl. ..... 446/387; 446/97; 446/114; 446/268

(58) Field of Search ..... 446/387, 97, 388, 446/116, 115, 114, 109, 108, 268, 98, 487, 488; 40/124.19, 605; 428/8, 9, 7; 273/156, 160, 157 R

(56) References Cited

U.S. PATENT DOCUMENTS

| | | | | | |
|---|---|---|---|---|---|
| 564,078 | A | * | 7/1896 | Jones | 446/387 |
| 927,499 | A | * | 7/1909 | Davis | 446/114 |
| 1,176,637 | A | * | 3/1916 | Anderson | 446/98 |
| 1,923,881 | A | * | 8/1933 | Palais | 446/114 |
| 2,111,129 | A | * | 3/1938 | Rittenhouse | 434/84 |
| 2,314,744 | A | * | 3/1943 | Warren | 446/387 |
| 2,706,357 | A | * | 4/1955 | Nigh et al. | 43/3 |
| 2,924,036 | A | * | 2/1960 | Rossiter | 40/613 |
| 3,564,758 | A | * | 2/1971 | Willis | 446/109 |
| 3,698,124 | A | * | 10/1972 | Reitzel et al. | 446/114 |
| 4,118,887 | A | * | 10/1978 | Appleman | 446/97 |
| 4,239,825 | A | * | 12/1980 | Kaulfuss et al. | 428/16 |
| 4,335,165 | A | * | 6/1982 | Powers | 428/8 |
| 4,722,537 | A | * | 2/1988 | Chau-Pin | 280/1.13 |
| 5,628,666 | A | * | 5/1997 | Tomczyk et al. | 446/114 |
| 5,681,041 | A | * | 10/1997 | Coon | 273/157 R |
| D398,337 | S | * | 9/1998 | LaPointe | D21/484 |
| 5,895,306 | A | * | 4/1999 | Cunningham | 446/108 |
| 6,120,344 | A | * | 9/2000 | Brown | 446/388 |
| 6,149,487 | A | * | 11/2000 | Peng | 446/114 |
| 6,179,681 | B1 | * | 1/2001 | Matos | 446/116 |
| 6,257,946 | B1 | * | 7/2001 | Yang | 446/34 |
| 6,419,542 | B1 | * | 7/2002 | Liu | 446/97 |
| 6,439,953 | B1 | * | 8/2002 | Liu | 446/387 |
| 6,475,054 | B1 | * | 11/2002 | Liu | 446/98 |

FOREIGN PATENT DOCUMENTS

| | | | | | |
|---|---|---|---|---|---|
| DE | 20120352 | U1 | * | 2/2002 | A63H/3/10 |
| FR | 1002582 | A | * | 3/1952 | A63H/3/16 |
| FR | 2703599 | A1 | * | 10/1994 | A63H/33/42 |
| GB | 2054393 | A | * | 2/1981 | A63H/33/08 |

* cited by examiner

*Primary Examiner*—Derris H. Banks
*Assistant Examiner*—Urszula M Cegielnik
(74) *Attorney, Agent, or Firm*—Sughrue Mion, PLLC

(57) ABSTRACT

Disclosed is a character toy which can be fabricated with the use of a component pattern sheet for the character toy, on which bodily components of the character toy and component connecting plates are arranged, the bodily components being formed with at least one connecting slit, and the component connecting plates being formed with a plurality of connecting slits through which the bodily components are coupled to each other at any selected angles, and a clothing pattern sheet for the character toy on which clothing elements to be put on the bodily components fabricated for the character toy are arranged.

7 Claims, 5 Drawing Sheets

CHARACTER TOY

BACKGROUND OF THE INVENTION

1. Field of the Invention

The present invention relates in general to character toys, and more particularly, to a character toy fabricated with the use of one or more pattern sheets available for fabricating the character toy, wherein the pattern sheet is prepared in such a manner that the character toy's shapes and/or poses can be formed in various manners, as desired by the customers.

2. Description of the Prior Art

Generally, a character as a toy has one or more illustrated images in connection with an object to be represented by the character, usually produced for commercial purposes. Because the character gives the customers a feeling of intimacy and/or appeals to the customers so as to invite them to purchase it, there has been a tendency that such illustrated image(s) have been more frequently employed in toys. Such toys may be referred to as "character toys."

However, if character toys are sold in the form of finished products, they would merely stimulate the customers to be temporarily curious about them. In the case of children, they may be readily bored of the character toys fabricated in the form of finished products. In other words, such character toys would possibly fail to arouse the customers' interest in a continuous manner.

In an effort to solve this shortcoming, there have been attempts to arouse the customers' interest continuously by inviting them to complete a character toy based on one or more drawings for assembling it. However, where the shape of the character when completed is predetermined, the processes of assembly would result in achieving only simple and repeated activities, and for this reason, it could not be expected from this attempt that the children's creativity, or ability to make space, or to represent the space in three dimensions, will be developed.

Korean Patent Laid-open Publication No. 10-2001-0076128, filed by the same inventor of the present invention, discloses a paper toy using one or more pattern sheets wherein all the bodily components for building the body of a character are approximately represented on a pattern sheet, and they are cut by scissors or other cutting tools, and then fabricated so as to make a toy. Clothing parts for the toy are cut from another pattern sheet then attached to the toy, thus producing a toy wearing clothing. Through these processes, characters illustrating human beings, animals and robots can be fabricated, shapes and motions proper to the characters can be represented, and characters and shapes thereof can also be represented in three dimensions. However, even in this case, all the bodily components for the character must be first cut from the pattern sheet, by means of cutting tools such as scissors, in order to assemble them. At this time, a process of detaching all the bodily components of a character from the pattern sheet would cause a great inconvenience. In addition, the lines of each bodily component, resulting from detachment from the pattern sheet, are not so clear; for this reason, it is not easy to smoothly fabricate the character with the use of the detached bodily components.

SUMMARY OF THE INVENTION

Therefore, the present invention has been made in an effort to solve the above-mentioned problems, and it is an object of the present invention to provide a character toy which can be fabricated with the use of one or more pattern sheets for making the character toy, wherein the bodily components constituting the character toy can be detached from the pattern sheet(s) without using separate tools for detachment, and the detached bodily components can be assembled with each other at any angle as selected by the customer, thereby enabling the shape and/or pose of the character toy to be represented in various manners.

In accordance with the present invention, the above and other objects can be accomplished by the provision of a character toy which can be fabricated with the use of a component pattern sheet for the character toy on which bodily components of the character toy and component connecting plates are arranged, the bodily components being formed with at least one connecting slit, the component connecting plates being formed with a plurality of connecting slits through which the bodily components are coupled to each other at any desired angle, and a clothing pattern sheet for the character toy on which clothing elements to be put on the bodily components fabricated for the character toy are arranged, wherein the component pattern sheet and the clothing pattern sheet are processed to allow the bodily components, component connecting plates and clothing elements arranged thereon to be easily detached from the sheets

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Preferred embodiments of the present invention will be described in more detail with reference to the accompanying drawings.

Figure 1:
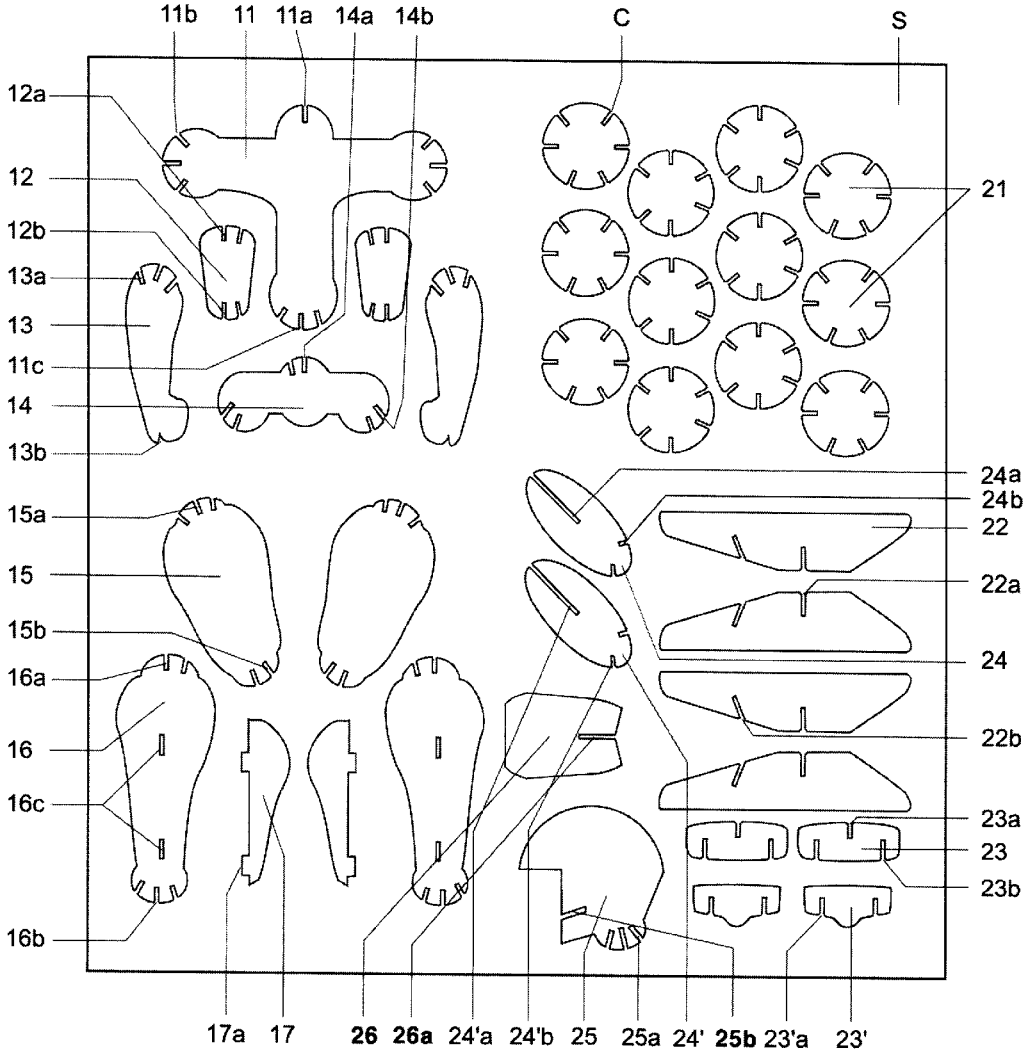
FIG. 1 is a top plan view of a pattern sheet for bodily components of a character toy according to the present invention.

FIG. 1 is a top plan view of a pattern sheet for bodily components of a character toy according to the present invention. A preferred embodiment of the character toy according to the present invention refers to a rugby player for the sake of convenience in description. In this regard, the bodily components necessary for fabricating the character toy correspond to bodily parts of a rugby player, and plates for connecting the bodily components are replaced with joint parts 21.

Referring to FIG. 1, a pattern sheet S for bodily components (alternately referred to as "component pattern sheet") of the character toy according to a preferred embodiment of the present invention is comprised of a sheet in a rectangular plane, the sheet S being to some degree thick.

The component pattern sheet S includes all the bodily components for forming the whole body of a rugby player.

(for example, a torso part 11, two upper arm parts 12, two lower arm parts 13, a pelvis part 14, two thigh parts 15, two calf parts 16, two plates 17 for reinforcing the calf parts 16, etc.) arranged thereon.

The bodily components arranged within the component pattern sheet S will be described in more detail, referring to FIG. 1. The torso part 11 as a whole takes the form of a cross, having one connecting slit 11*a* formed on the top, and three connecting slits 11*b*, 11*c* respectively formed on both shoulders and the waist. Each upper arm part 12 has two connecting slits 12*a* and 12*b* formed respectively on the top and on the bottom, and each lower arm part 13 has three connecting slits 13*a* formed on the top and one connecting slit 13*b* formed on the bottom.

The pelvis part 14 has two connecting slits 14*a* and 14*b* formed respectively on the top and on both sides. Three connecting slits 15*a* are formed on the top of each thigh part 15 and two connecting slits 15*b* are formed on the bottom thereof.

Each calf part 16 has two connecting slits 16*a* formed on the top and three connecting slits 16*b* formed on the bottom. Inside each calf part 16 are formed two connecting slots 16*c*. In addition, each plate 17 for reinforcing the calf parts 16 is provided on one side thereof with two inserting projections 17*a*, to be inserted into the connecting slots 16*c* of the associated calf part 16.

Each joint part 21 takes the form of a circular plate, being provided to assemble all the bodily components of the body to each other at any desired angle. On the outer circumferential edge thereof are a plurality of connecting slits C formed in a radial direction.

A shoe part 22 is provided in two pairs, each pair comprising two pieces being opposite to each other. Each piece of the shoe part 22 has two connecting slits 22*a* and 22*b*, the former being formed at a position around the middle portion of an upper edge of the piece and the latter being formed at a position after the middle portion of the upper edge. Especially, the second connecting slit 22*b* formed at the position after the middle portion of the upper edge is inclined relative to the first connecting slit 22*a*.

Plates 23 and 23', for connecting the shoe parts 22, comprise two primary plates 23 and two secondary plates 23' relatively shorter in length than the primary plates 23. Each primary plate 23 has one connecting slit 23*a* at a middle portion of the top edge thereof, which will be inserted into any one of the connecting slits C on the joint parts 21 coupled to the calf parts 16, with two connecting slits 23*b* formed on both sides of the lower edge of each primary plate 23, each of which will be coupled to the connecting slit 22*a* formed at the middle portion of the upper edge of the shoe part 22. Each secondary plate 23' has two connecting slits 23'*a* to be coupled to the inclined connecting slits 22*b* of the shoe part 22.

A rugby ball is comprised of two oval parts 24, 24', each of which is formed with a connecting slit 24*a*, 24'*a* extended to the center thereof in a radial direction. On the lower side of the second part 24' of the rugby ball are formed a plurality of connecting slits 24'*b* through which the rugby ball will be affixed to the body.

A head part 25 corresponding to a helmet for a rugby player has three connecting slits 25*a* formed on an edge connected to the torso part 11, taking the streamline shape as a whole.

The above-mentioned bodily components arranged on the pattern sheet S are sharply cut by a processing means so as to be easily detached from the sheet S. In other words, the bodily components are sharply cut by a processing means and they are then engagedly fixed onto the pattern sheet S, and thus, the bodily components can be easily detached from the pattern sheet without forcing a user to use a separate cutting tool. A conventional method of directly cutting the bodily components, by means of a cutting tool such as scissors and the like, have not made the edges of the cut bodily components clear; further, in a case where the bodily components are inexactly or clearly cut, the bodily components are not available for building the toy any longer, thereby causing a big problem in completing assembly of the toy itself. However, in the case of the pattern sheet for a character toy according to the present invention, such a problem has been overcome. The processing means mentioned above is preferably comprised of a mold knife. It may be preferable that the sheet is made of polystyrene, which is a nontoxic plastic material.

The sheet S, the bodily components, and component connecting plates of the pattern sheet S, and the connecting slits formed on the bodily components and component connecting plates, may be modified in various manners without departing from the technical idea or concept for the present invention. For example, the sheet S may be provided in a single sheet or a plurality of sheets depending on the size or shape of the character toy. The order or form of the bodily components and the component connecting plates arranged on the sheet S may also be modified as necessary. The number of the connecting slits may also increase or decrease depending on the shape or pose of the character selected.

Figure 2:
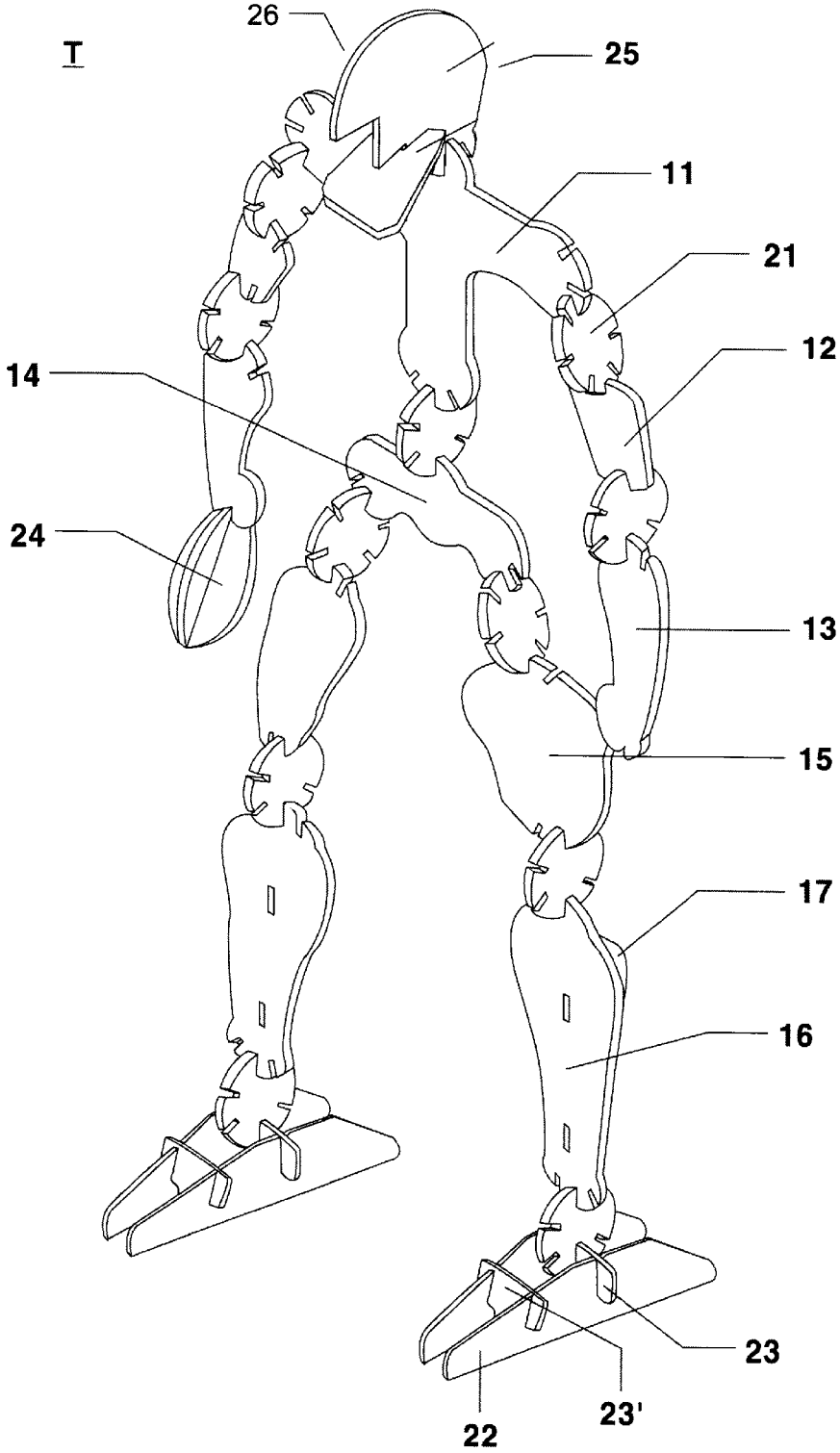
FIG. 2 is a perspective view of the character toy according to one embodiment of the present invention, fabricated using the pattern sheet of FIG. 1.

The bodily components detached from the component pattern sheet S are fabricated to build a character toy T as shown in FIG. 2 through the following assembling process.

First, the bodily components, corresponding to each bodily portion of the character, sharply cut and arranged on the component pattern sheet S are manually detached from the sheet S. Then, the connecting slits 11*a*, 11*b*, 11*c* on the detached torso part 11 are combined with the connecting slits C of a desired number of joint parts 21 according to any desired angle, and the connecting slits of the torso part 11 not combined with the joint part 21 are combined with the connecting slits 25*a*, 12*a*, 14*a* on the head part 25, the upper arm parts 12 and the pelvis part 14 according to any desired angle. Two additional joint parts 21 are coupled to the connecting slits 12*b* of the combined upper arm parts 12 through the connecting slits C. The lower arm parts 13 are coupled to the above joint parts 21 through the connecting slits 13*a*, thus being coupled to the upper arm parts 12. Through these processes, the upper body of a character toy according to the present invention is fabricated.

The same principle as used in fabrication of the upper body is applied to fabrication of the lower body. The pelvis part 14, the two thigh parts 15, and the two calf parts 16 are combined with one another in sequence at any selected angle with the use of the joint parts 21. The two inserting projections 17*a* of each calf reinforcing plate 17 are first inserted into the two connecting slots 16*c* of each calf part 16, to give a feeling of volume like a real calf and to support the body of the character toy more stably.

The connecting slit 23*a*, formed at the middle portion on the top edge of each first shoe connecting plate 23, is combined with any one of the connecting slits C of the joint part 21 combined with each calf part 16, and the connecting slits 23*b* formed on both sides of the lower edge thereof are respectively coupled to the connecting slits 22*a* formed at positions around the middle portion of the upper edge, and the connecting slits 23'*a* formed on both sides of the lower edge of each second shoe connecting plate 23' are coupled to the connecting slits 22*b* formed at rear positions on the upper edge of the shoe part 22. At this time, since the connecting slit 22*b* after the middle portion of the shoe part 22 is inclined, an angle between the connecting slits 22*b* and 23'*a* for coupling the shoe part 22 to the shoe connecting plates 23 and 23' is enlarged. Thus, the availability for coupling the shot part 22 is improved. Also, since the first shoe connecting plates 23 coupled to the shoe part 22 are longer in their lengths than the second shoe connecting plates 23', the shoe part 22, after being assembled, is tapered in shape. Thus, the shoe part 22 can stand more stably and unshakably.

Following the above-mentioned processes, if the character toy T for a rugby player is completely fabricated, a connecting slit 24*b* of the rugby ball, formed by coupling the connecting slits 24*a*, 24'*a* of the two pieces to each other, is coupled to the connecting slit 13*b* of a lower arm part 13 or the shoe part 22.

According to an angle for coupling each joint part 21 to each bodily component, the rugby player can be represented as he is doing a try, a penalty kick or a drop kick, etc. According to the present invention, since children can determine the shape and/or pose of the rugby player by themselves, considering any angle they desire, when fabricating the character toy, this toy is very useful in improving children's ability to create space or to think from all angles, or their creativity, etc.

In one embodiment of the present invention described so far, a rugby player, was referred to as an example for a character toy. However, it is evident to one skilled in the art that the present invention can be applied to characters for players doing soccer, basketball, baseball and other sports, and as well to a variety of robots, animals or extraterrestrials.

By the way, the character toy according to the present invention can wear items of clothing using a pattern sheet. S' for clothing (referred to as "clothing pattern sheet"), in order to make it more realistic and more visually pleasing.

Figure 3:
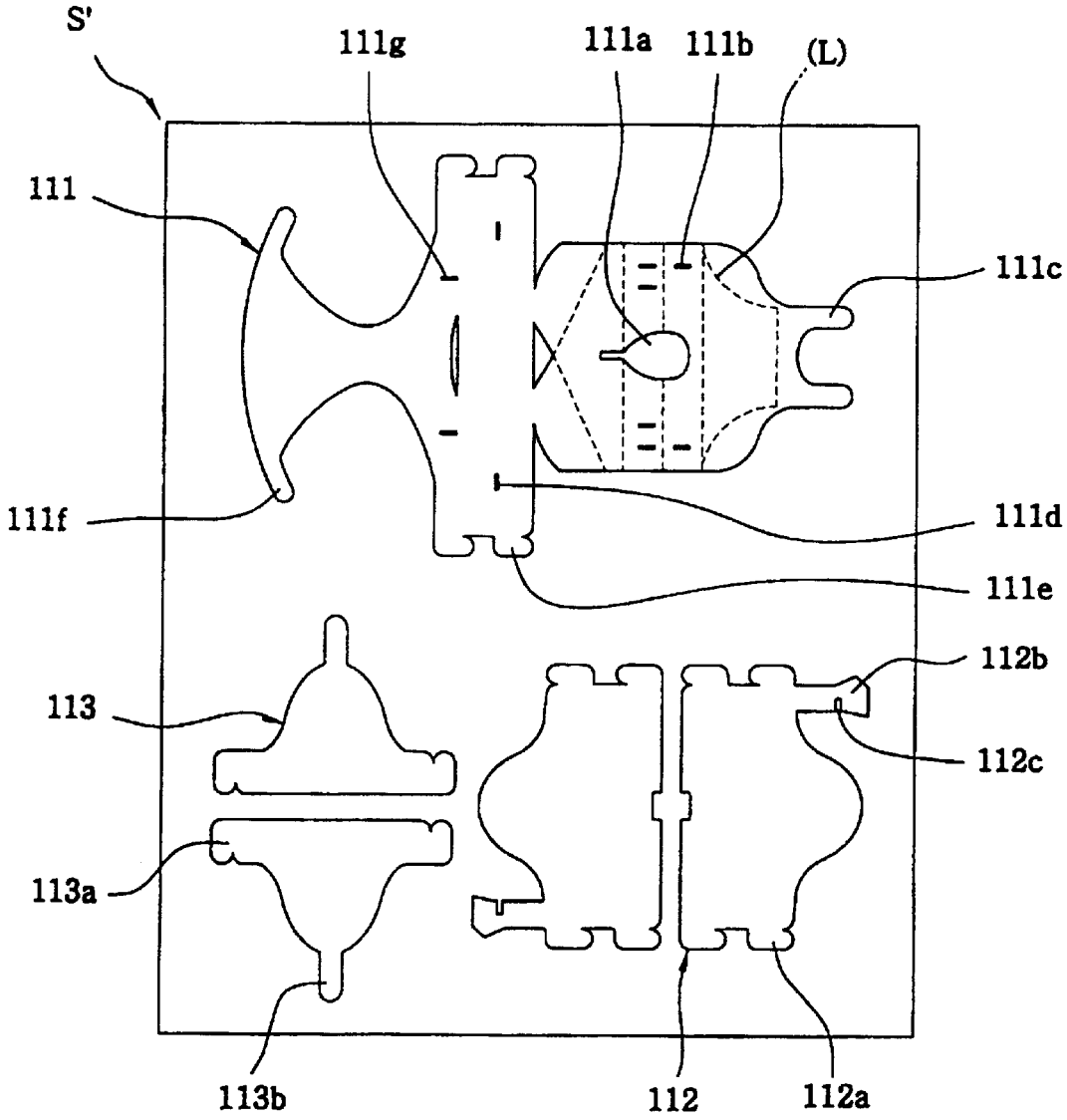
FIG. 3 is a top plan view of a pattern sheet for clothing elements for the character toy according to one embodiment of the present invention.
Figure 4:
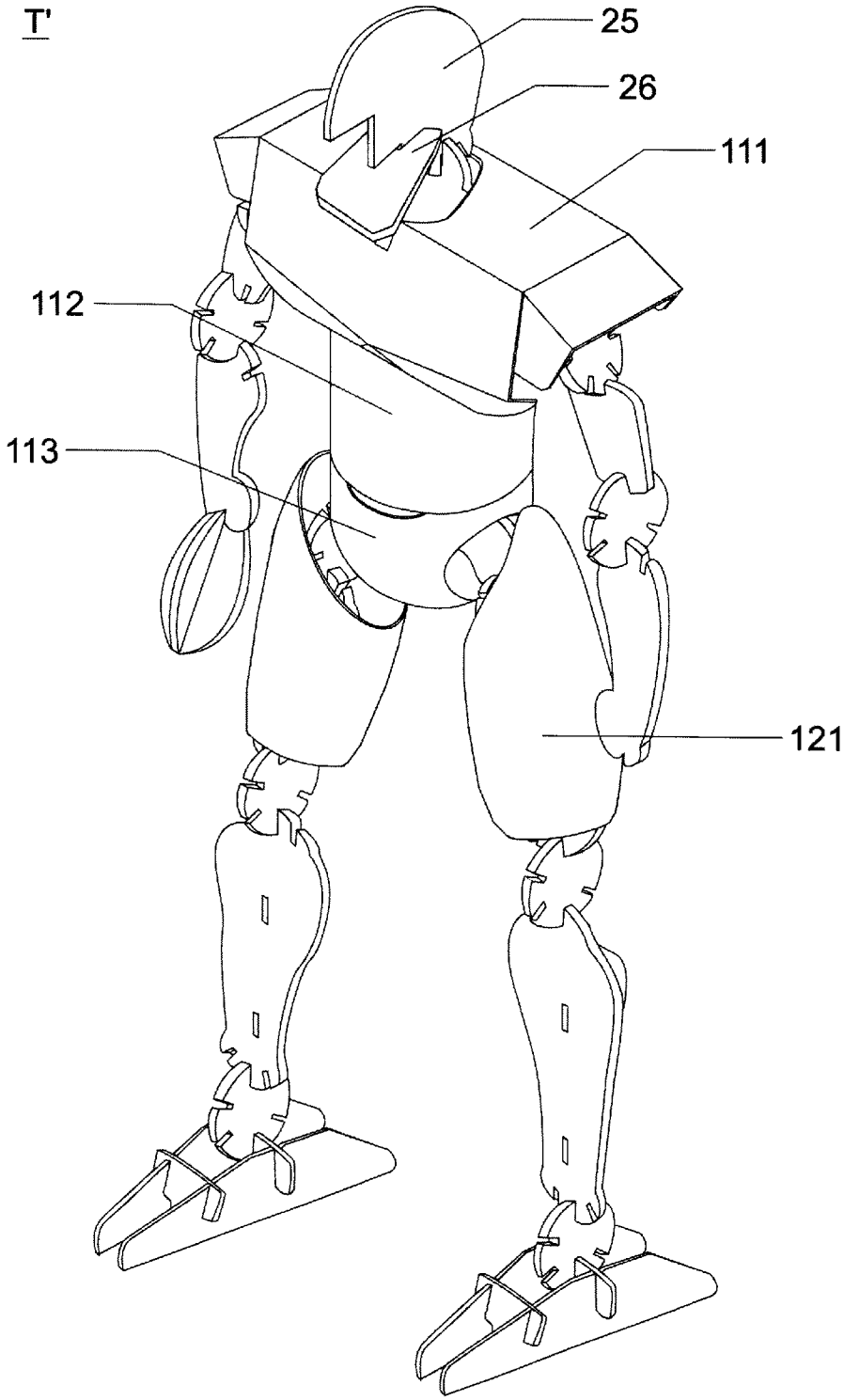
FIG. 4 is a perspective view of the character toy of FIG. 2, wearing provided clothing, the elements of which are detached from the pattern sheet of FIG. 3.

FIG. 3 is a top plan view of a pattern sheet S' for clothing elements for the character toy T according to another embodiment of the present invention, and FIG. 4 is a perspective view of a character toy T' after the character toy of FIG. 2 wears the clothing, the elements of which are detached from the pattern sheet S' of FIG. 3.

Upon the clothing pattern sheet S' are arranged all the patterns for the clothing, corresponding to all the bodily components, to be put on the bodily, components for the character toy T. Elements of the clothing have cut lines by a processing means so as to allow them to be easily detached from the sheet S'.

Referring to FIG. 3, an upper garment 111, pants 112 and sleeves 113 are arranged on the clothing pattern sheet S'. To explain them in more detail: the upper garment 111 is comprised of a head connecting hole 111*a* made on the middle portion thereof, through which the head part 25 passes, a plurality of first slots 111*b* formed on the left and the right sides of the head connecting hole 111*a*, two first projections 111*c* formed around the first slots 111*b*, two second slots 111*d* formed around the waist part, through which the first projections 111*c* are inserted, a plurality of waist connecting wings 111*e* formed around the second slots 111*d* for connecting the waist part, two second projections 111*f* projected from the upper garment 111 at positions around both sides of the pants part, and two third slots 111*g* formed around the waist part, through which the second projections 111*f* are allowed to pass. Herein, the upper garment 111 is made with a folded line L so as to make it easy to wear it on the character toy T, and the folded line is shown in FIG. 3 as dotted lines.

The pants 112 are provided in two elements which will be coupled to both thighs, comprising a plurality of pants connecting wings 112*a* and a third projection 112*b*, the third projection 112*b* being formed with a connecting slit 112*c* around the upper connecting wings 112*a*.

The sleeves 113 are prepared in two elements so as to be assembled to both shoulders of the body, comprising a plurality of sleeve connecting wings 113*a* formed on both sides thereof and a fourth projection 113*b* projected at the middle portion thereof.

The clothing pattern sheet S' arranged as mentioned above is processed so as to allow the clothing elements to be easily detached from the clothing pattern sheet S'. Thus, the clothing elements can be easily detached from the clothing pattern sheet S' without using a separate cutting tool.

Preferably, the clothing pattern sheet S' is made of polystyrene, a non-toxic plastic material, and is produced through a pressing or injection molding process.

In the same manner as that described for the component patterns sheet S, the clothing pattern sheet S' described above may be modified in various manners without departing from the technical idea or concept for the present invention. For example, the sheet S' may be arranged differently depending upon the size or shape of the clothing, and the sheet S' may be fabricated in the form of a single sheet or a plurality of sheets, without limitation.

The clothing elements are detached from the clothing pattern sheet S' and then put on the character toy T of FIG. 2, thereby completing the character toy T' wearing the clothing as depicted in FIG. 4. Visual appeal and decorative effect of the character toy are maximized by putting clothing on it.

To fabricate the upper garment 111, the upper garment 111 is folded along the folded lines L. The assembled head part 25 of the character toy is inserted into the head connecting hole 111*a* and the waist part is fabricated through the waist connecting wings 111*e*. Then, the first projections 111*c* of the upper garment 111 are inserted into the second slots 111*d*.

To fabricate the pants 112, the connecting slits 112*c* of the third projections 112*b* are first coupled to each other, in order to prevent the pants. 112 from being too tight around the thigh parts 15, and then the pants connecting wings 112*a* are then coupled to each other.

To fabricate the sleeves 113, the fourth projections 113*b* are inserted into the first slots 111*a* of the upper garment 111 in order to prevent the sleeves 113 from being too tight around the upper arm parts 12, and then the sleeve connecting wings 113*a* are coupled to each other. Through these processes, fabrication of the character toy T' putting on the clothing is completed as shown in FIG. 4.

The clothing may be modified to a uniform for a rugby player in a specific country or rugby team, etc. by employing colors and shapes proper to the country or the team, etc.

Figure 5:
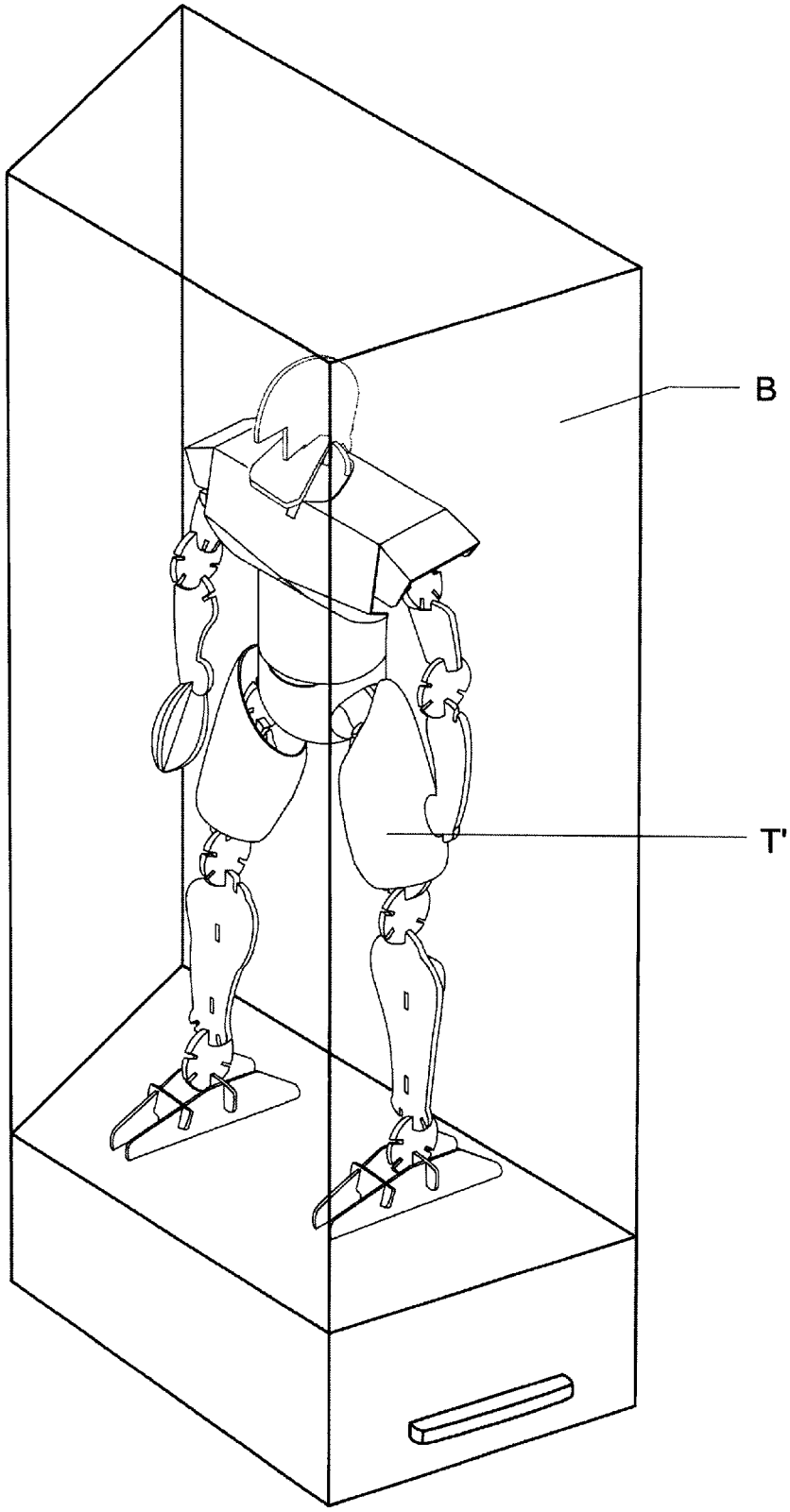
FIG. 5 is a perspective view showing the character toy wearing the clothing being placed within a case.

By the way, according to the present invention, the character toy T' putting on clothing may be fabricated as placed within a case B, as shown in FIG. 5. At this time, one or more images for advertisement or promotional activities can be displayed on the outer surface of the case B.

As apparent from the above description, the character toy according to the present invention is fabricated with the use of one or more pattern sheets S, S' on which a plurality of bodily components sharply cut by a processing means are arranged, and thus the bodily components for the character toy are easily detached from the sheets. In addition, since the outer circumferential edges of the bodily components sharply cut by a processing means is clear, it is relatively easy to fabricate them. Further, the detached bodily components may be fabricated with plates for connecting the bodily components at any selected angle, being formed with a plurality of connecting slits in radial directions, thereby making it possible to represent various shapes and/or poses of the character toy. Accordingly, the present invention is effective in enhancing children's creativity and/or ability to make space or think from all angles, etc.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A character toy fabricated with the use of a component pattern sheet for the character toy on which bodily components of the character toy and component connecting plates are arranged, the bodily components being formed with at least one connecting slit, the component connecting plates being formed with a plurality of connecting slits through which the bodily components are coupled to each other at any desired angle, and a clothing pattern sheet for the character toy on which clothing elements, to be put on the bodily components fabricated for the character toy, are arranged, wherein the component pattern sheet and the clothing pattern sheet are processed so as to allow the bodily components, component connecting plates, and clothing elements arranged thereon to be easily detached from the sheets.

2. The character toy according to claim 1, wherein the bodily components are comprised of a head part, a torso part, upper arm parts, lower arm parts, a pelvis part, thigh parts, calf parts, a shoe part and shoe connecting plates, and the component connecting plates are comprised of a plurality of joint parts, and the clothing elements are comprised of an upper garment, sleeves and pants.

3. The character toy according to claim 1, wherein the component pattern sheet for the character toy is processed with a mold knife, and the clothing pattern sheet is processed through a pressing or injection molding process.

4. The character toy according to claim 2, wherein the shoe part is produced in two pairs of pieces, each pair of pieces of the shoe part being opposite to each other and each having a first connecting slit at a position around a middle portion of an upper edge thereof and a second connecting slit at a position after the middle portion, said second connecting slit being inclined relative to the first connecting slit.

5. The character toy according to claim 2, wherein the shoe connecting plates are produced in two pairs of pieces having different lengths such that the shoe connecting plates allow the fabricated character toy to stand stably.

6. The character toy according to claim 1, wherein the character toy is placed within a case whose outer surface is used for advertisements or promotional activities.

7. The character toy according to claim 4, wherein the shoe connecting plates are formed with connecting slits at lower edges thereof to connect each pair of pieces of the shoe, part to each other, the connecting slits provided at the lower edges of the shoe connecting plates being coupled to the first and second connecting slits of the shoe part.

* * * * *